United States Patent [19]

Templeton

[11] 4,230,312

[45] Oct. 28, 1980

[54] ITEM SORTER POCKET FLAG AND SWITCH APPARATUS

[75] Inventor: William B. Templeton, Howell, Mich.

[73] Assignee: Burroughs Corporation, Detroit, Mich.

[21] Appl. No.: 953,647

[22] Filed: Oct. 23, 1978

[51] Int. Cl.[3] ..... B65H 31/04

[52] U.S. Cl. ..... 271/215; 271/220

[58] Field of Search ..... 271/214, 215, 217–219, 271/220, 3.1; 414/103, 106–109, 100

[56] References Cited

U.S. PATENT DOCUMENTS

| | | | |
|---|---|---|---|
| 3,051,480 | 8/1962 | Carlin et al. | 271/215 |
| 3,682,473 | 8/1972 | Kuyt | 271/3.1 |
| 3,790,004 | 2/1974 | Tole et al. | 271/215 |

*Primary Examiner*—Robert B. Reeves
*Assistant Examiner*—Brian Bond
*Attorney, Agent, or Firm*—Carl Fissell, Jr.; Delbert P. Warner; Charles E. Quarton

[57] ABSTRACT

A sorter pocket flag back-up assembly and switch indicating means comprises a non rotatable rectilinearly, slideably moveable support member engageable with one side or face of an item entering the pocket of a sorter including a zero clearance bearing and an integral linear rack having radially disposed teeth engageable with a drive pinion coupled to a reversible stepping motor. The support and rack include a lower guide track coextensive with the rack and an upper spring loaded pin which together maintain a constant depth engagement of the pinion and rack teeth and avoid any tilt of the rack transverse to the long dimension thereof. A pedestal mounted switch arm having an item contacting tang at one end and optical switch interruptor means at the opposite end is pivotally mounted on the pedestal for swinging movement toward and away from the items and the back-up flag assembly effective to energize and deenergize the stepping motor as the stack of items in the pocket enlarges or diminishes thereby effectively controlling the positioning of the flag assembly and indicating an empty or full condition of the sorter pocket.

7 Claims, 6 Drawing Figures

ITEM SORTER POCKET FLAG AND SWITCH APPARATUS

The present invention incorporates by reference the disclosure of U.S. patent application Ser. No. 945,523 filed Sept. 25, 1978 in the name of William B. Templeton entitled Zero Clearance Linear Bearing assigned to the same assignee as the present invention.

BACKGROUND OF THE INVENTION

The present invention relates to item sorters and to an item sorter pocket receptacle. More specifically the invention has to do with the back-up assembly of flag apparatus for an item sorter pocket and to means for controlling the movement of the flag back-up assembly as the pocket fills with items and for indicating the pocket condition as filled or empty so as the prevent an overfill or jam of items.

DESCRIPTION OF THE PRIOR ART

Because many, if not most of the items, sorted by the modern item sorter are relatively flimsy and incapable of freely standing, means must be provided to stack such items one after the other close together in a prescribed order and to support such items once they are stacked. While it is possible to stack such items as checks and the like in a flat condition, one on top of the other, the more usual and conventional technique is to sort and stack such items on edge. This operation of necessity requires some sort of back-up member as a support for the stacked items. Such support must also of necessity move laterally so that each now item may be stacked in the pocket receptacle out of the way of the next incoming item so as to prevent jams and/or overlap of the items.

In the past, such back-up members have been spring loaded toward a vertical wall or used a pivot and spring to load the back-up member toward the items or often such back-up members are moved by a weight and pulley arrangement; the weight being calibrated to accommodate a certain number or stack of items without too high a build up of resistant force against the incoming items.

However, these types of back-up devices all suffer from an inability to accommodate a desired number of items without the previously stacked items interfering with the incoming items to an extent that the items tend to overlap and/or jam up upon entering a partially filled pocket or receptacle.

SUMMARY OF THE INVENTION

The present invention solves the foregoing and other problems associated with high speed item stackers and sorters by novel and unobvious means wherein a rectilinearly, slideably moveable stacker pocket back-up assembly or flag supported by means of a zero clearance bearing is moveable on an elongated support member by means of a reversible stepping motor. A switch mechanism operably associated with the flag assembly and including means contacting the item stack is provided with an optical interruptor for controlling the energization and deenergization of the stepping motor so as to cause the flag assembly to move from a closed pocket position to an open pocket position and return relative to stack of items effective to maintain a constant minimal seperation between the flag and a fixed reference as well as to indicate a full or an empty pocket or receptacle without permitting items to jam up or overlap with respect to one another. Movement of the flag assembly is produced by means of a rack and pinion combination wherein the rack teeth are radially offset with respect to the pinion teeth thereby to maintain the rack teeth in uniform engagement with the pinion teeth regardless of any tilt of the flag assembly and wherein a rack guide in cooperation with a pressure pin maintains the flag assembly in a true vertical relation with respect to a fixed plane of reference regardless of the actual position of the rack with respect to the pinion.

DESCRIPTION OF THE PREFERRED EMBODIMENT

Item-document sorting apparatus, such for example as check sorters, often employed in banking institutions utilize devices and apparatus which read and feed check items from an input hopper or receptacle to a read and/or view station. Thence the items are fed to a stacker pocket or receptacle from which the items can then be retrieved in accordance with a prearranged scheme or program of item routing or handling. Apparatus construction and function varies from manufacturer to manufacturer. However, a large portion of known and used sorter-stackers employ means within the stacker pocket-receptacle for indicating the pocket condition i.e. whether empty or full and in addition means is provided for edge aligning the items while feeding items in a prescribed order. With edge alignment it is necessary to provide means retaining the items in a vertical position or posture while enabling the pocket or receptacle to be filled and thereafter emptied by the operator without interference to or from the items or documents. Moveable back-up members weighted or spring loaded have been used in the past. However, it is extremely difficult and expensive to calibrate springs and weights which perform completely satisfactorily when the item pocket is nearly empty as well as when the item pocket is almost full. The bearings involved are either costly to manufacture or suffer from very high tolerance build up which in turn results in poor performance on the part of the moveable back-up structure.

Figure 1:
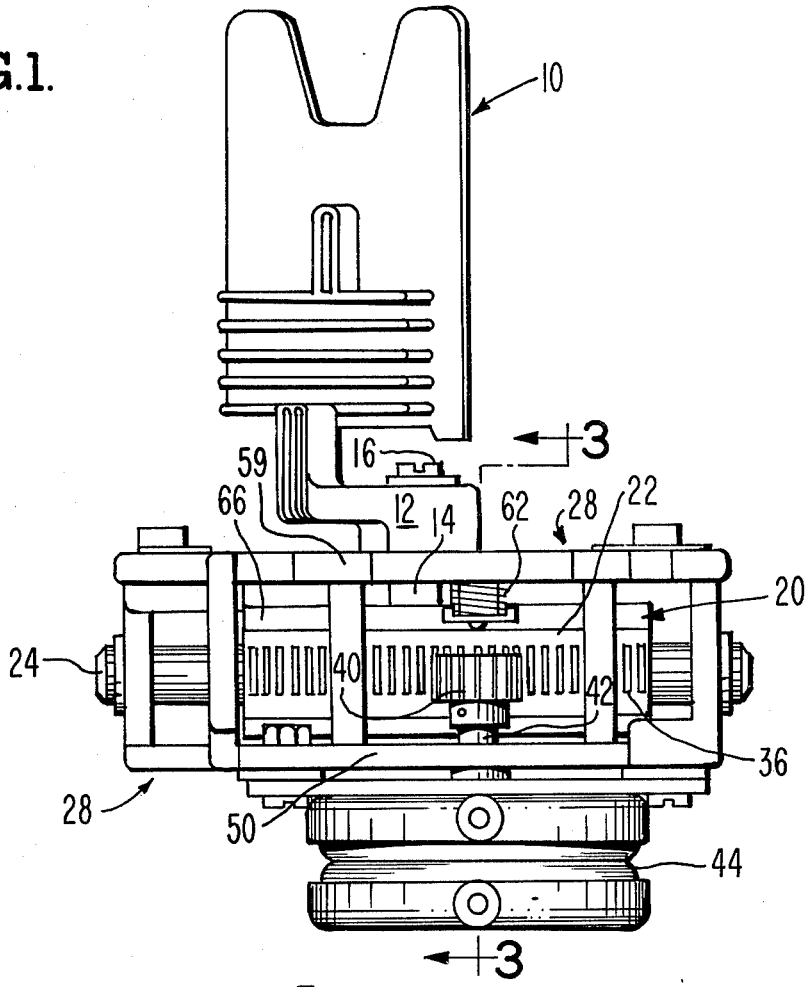
FIG. 1 is a front elevational view of the apparatus embodying the present invention.
Figure 2:
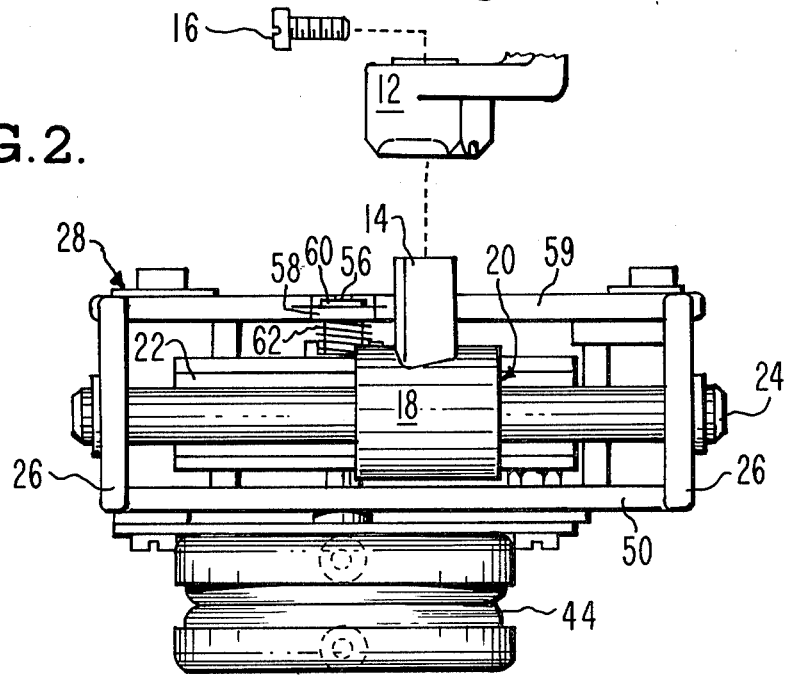
FIG. 2 is a rear elevational view of the apparatus of FIG. 1.
Figure 3:
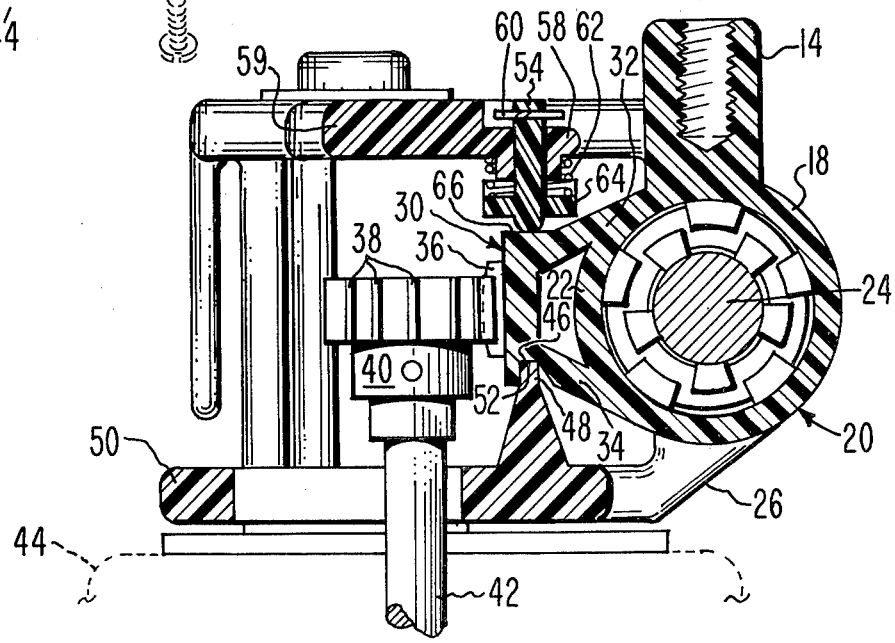
FIG. 3 is a sectional view along the line 3—3 of FIG. 1.

As seen most clearly in FIGS. 1, 2 and 3 the present invention solves these and other problems in a new, novel and heretofore unobvious manner. A moveable back-up member or flag assembly 10 is or may be cast, pressed or molded from rigid material such for example as plastic of a type commonly referred to as cycolac. Member 10 is an L-shaped, one piece, unitary, construction as seen in FIG. 1, including a plurality of horizontal and vertical strengthening ribs and a hollow pedestal-like mounting member 12 (slightly offset from the vertical portion throughof) and slideably, receivably mounted over an upstanding post 14 to which it is attached by bolt 16 FIG. 2. Post 14 is integral with and extends vertically upwardly from the central hub 18 of a zero clearance bearing 20 (the subject matter of U.S. Ser. No. 945,523 previously referred to herein above). Bearing member 20 and the integral rack portion 22 is slideably mounted on a cross shaft 24 extending between oppositely disposed shaft support members 26—26 integral with open rectangular flag mounting structure 28.

Rack 22, as seen most clearly in the end section of FIG. 3, is formed as by molding, etc., as an offset, elongated rigid structure 30 webbed to and integral with the main body portion of bearing 20 by means of the upper and lower fanned out integral members 32 and 34 respectively. The outwardly extending, exposed external face of structure 30 is provided with a plurality of radially molded rack teeth 36 FIGS. 1 and 3, which engage and mesh with teeth 38 of pinion drive gear 40. Gear 40 is secured as by a pin to the vertically disposed shaft 42 of bi-directional stepping motor 44. It is noted in this connection that the radius of curvature of teeth 36 of rack 30 enable the teeth 38 of gear 40 to constantly mesh therewith at a uniform depth of engagement regardless of any miniscule amount of vertical sidewise movement of the flag and bearing support.

Figure 4:
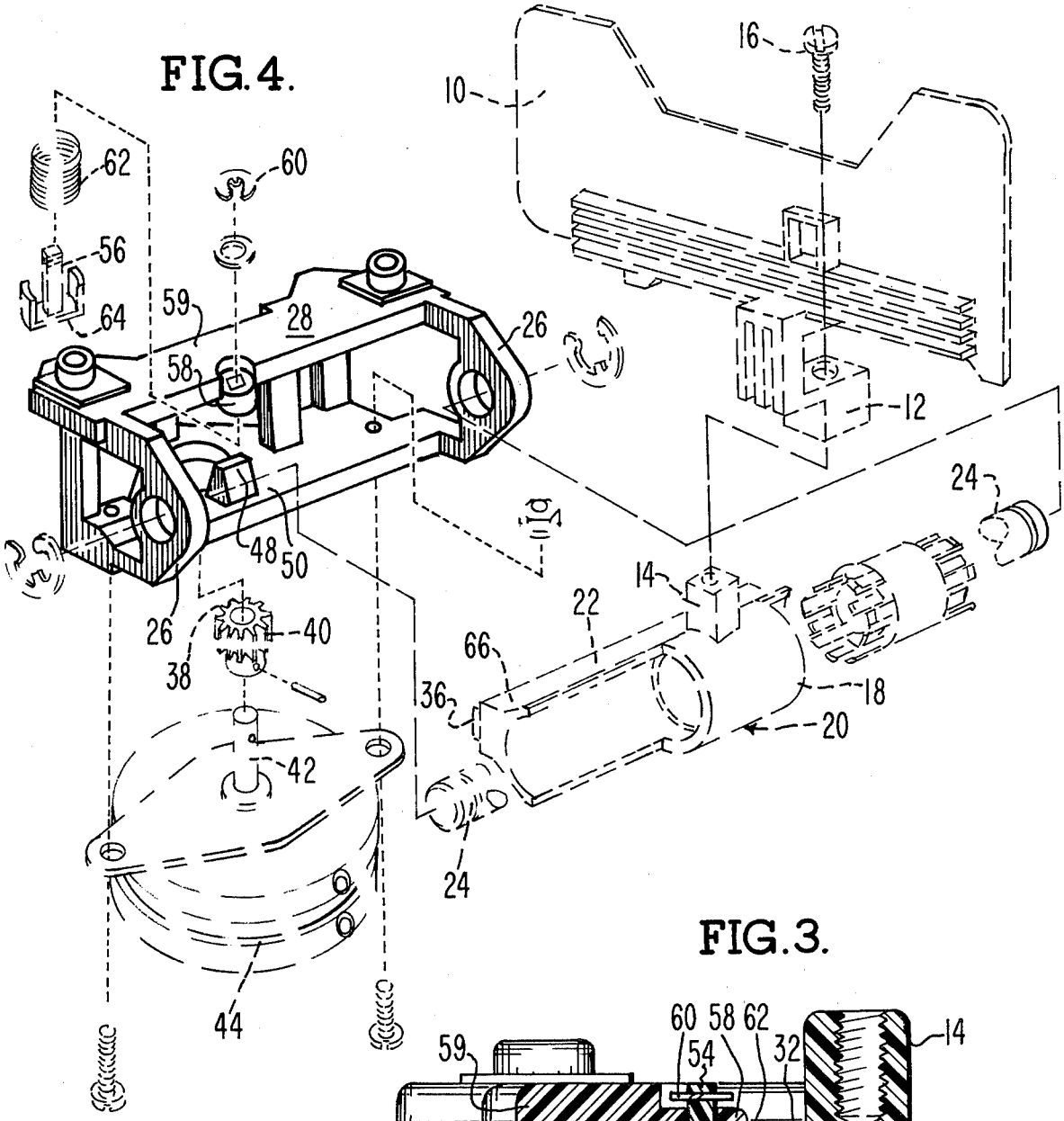
FIG. 4 is an exploded view of the apparatus of FIG. 1 illustrating the arrangement of the parts of the assembly to show their cooperative function.

In order to prevent any rotational wobble or yawing movement of flag assembly 10 the forward portion of the lower arm 34 is provided with a track or groove 46 extending lengthwise of member 30. A vertical projection 48 extending upwardly from base 50 of member 28 terminates in a narrowed end 52 slideably receivable in groove 46. A pin member 54 having a square shank 56 to prevent rotative movement, FIG. 4, is retained in boss 58 of the upper portion 59 of base structure 28 by means of a resilient "O ring" 61 and a c ring 60. A spring 62 retained against the interior of U-shaped member 64 biases pin 54 into constant engagement with the elongated flat surface portion 66 of bearing member 20 effectively preventing any rotative movement of member 20 relative to shaft 24, as the bearing carrying the flag assembly 10 is moved back and forth along shaft 24.

It is extremely important in the general operation of any sorter-stacker that the operator be continually aware of the status of each item receptacle or pocket i.e., whether that pocket is empty or full and/or whether and to what extent items have become jammed during entry into the pocket. The items enter receptacle on edge, as herein before described, and are ballistic or in free flight during the time when they exit from the sorter guideway (not shown) into the receptacle or pocket until they bottom on their edges within the receptacle. A lateral support member 68 forming an inner fixed reference wall member is located opposite back-up flag assembly 10 and is effective to enable such flimsy items as paper checks, etc., to enter the pocket receptacle area without overlap and/or jam-up as is often the case with high speed sorter-stackers for various reasons including lack of suitable control and the flimsy nature of the document.

Figure 6:
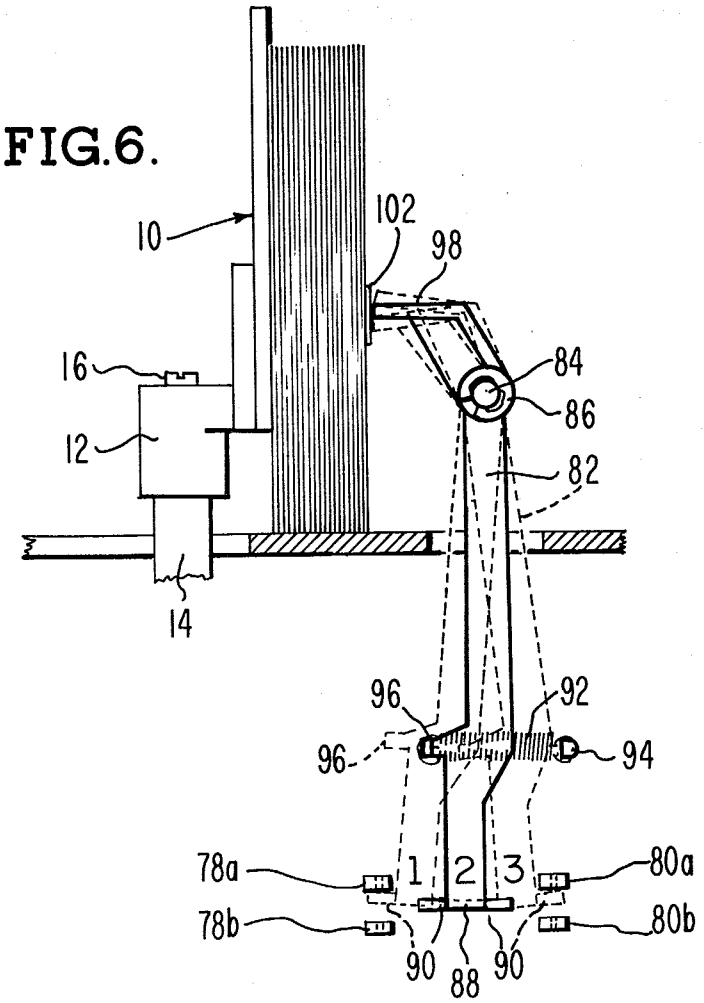
FIG. 6 is a side elevational view illustrating the movement of the switch actuator mechanism as the stack of items is varied in size.

A vertically disposed switch mounting bracket 70 is secured to the base of the receptacle or pocket (not shown) and is provided with an integral, upstanding, irregularly shaped vertical post or pillar 72 and a lower extension formed as a rectangular receptacle 74 open from both sides (front and back). A mounting block 76 of plastic material such for example as polysulfone which is capable of becoming transparent or almost transparent when formed, shaped or molded extremely thin in cross section is secured as by bolts (not shown) within the receptacle 74 as seen most clearly in FIG. 5. Mounting block 76 is molded or otherwise shaped to provide two outwardly projecting, confronting pairs of short tangs or posts 78*a* and *b* and 80*a* and *b* FIG. 6. A phototransistor and an LED (light emitting diode) combination is provided for each pair of tangs as seen in FIG. 6. Each such combination of phototransistor and LED forms a switch in the form of an optical interruptor as will be described shortly herein. The two switch members 78 and 80 are electrically connected to stepping motor 44 in such manner as to enable the motor to be energized in each of two opposite directions depending upon which switch is actuated as described hereinafter.

A pivotally moveable switch actuating arm 82 is pivoted to vertical post 72 by means of a boss 84 integral with the upper end of post 72. A C ring 86 retains switch arm 82 to the boss. The lower end of switch arm 82 terminates in a paddle like member 88 integral with arm 82 provided with oppositely disposed flat blades 90 extending at right angles to the main body portion of arm 82. A biasing spring 92 mounted between a fixed tab 94 on bracket 72 and an inwardly turned tab 96 on switch arm 82 urges switch arm 82 rightwardly as seen in FIGS. 5 and 6.

Figure 5:
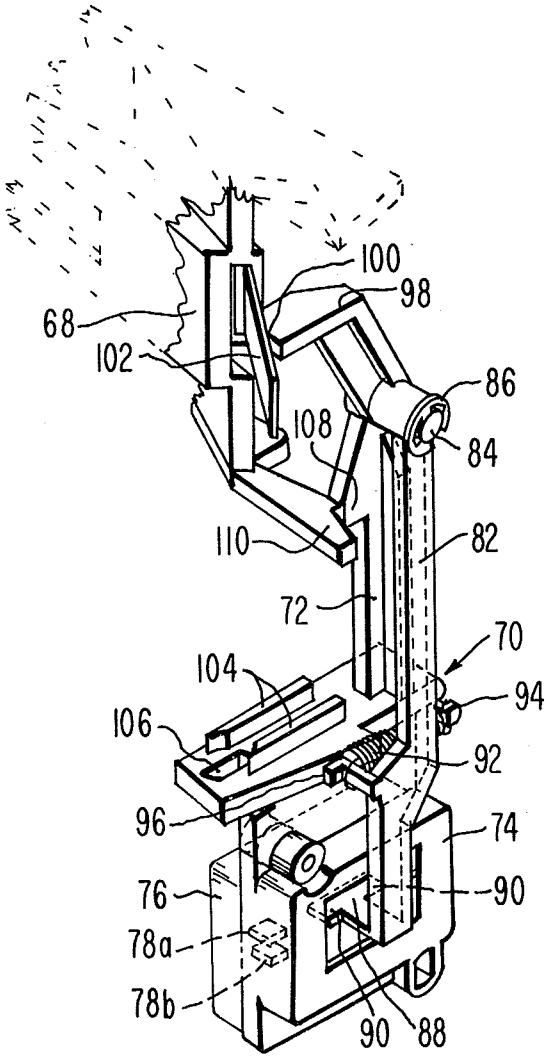
FIG. 5 is a perspective view of the switch actuator mechanism in conjunction with the stack of items.

The extreme upper end portion of switch actuating arm 82 terminates in an enlarged angular projection or tang 98 integral with arm 82 and angled leftwardly away from the vertical plane of arm 82, as viewed in FIGS. 5 and 6. As seen most clearly in FIG. 5., tank 98 is angularly formed or cut away as at 100 to provide a flat, short narrow edge which engages flexible member 102. Member 102 extends outwardly, angularly away from member 68 acting as a protective guide or bumper to take up any shock-impact of items entering the pocket-receptacle by causing such items to glide or slide smoothly thereover while still pushing rightwardly against the switch actuator arm member 82 so as to activate the optical interruptors 78*a* and *b* and 80*a* and *b* without momentary sensing or jiggling of the switches. Member 102 also prevents the items from hanging up on member 98 as they move in free flight into the pocket-receptacle.

Switch bracket 70 is mounted to the base of the sorter/reader apparatus (not shown) by means of the raised orienting lands 104 and the slotted mounting aperture 106.

So as the afford ease of installation and adjustment the switch actuator arm support pedestal 72 carrying switch arm 82 is provided with an irregularly shaped projection 108 extending outwardly into surface contact with the horizontally, forwardly, projecting member 110 of member 68. When the switch apparatus is mounted in place member 110 acts as a positioning limit or stop against which the member 108 abuts as seen in FIG. 5.

As seen in FIG. 6 three switch positions are shown (labeled 1-2-3). In the central or neutral position (2) the pocket or receptacle (not shown) is free and clear and available for incoming items and the sorter electrical circuit logic is in condition to sort items. As items enter the pocket the clearance between the inner surface of flag 10 and the overlapping member 102 against member 98 of switch arm 82 is incrementally reduced by each item. Once this space is reduced below a predetermined minimum (0.0030) the switch arm 82 is moved rightwardly moving the beam interruptor 90 leftwardly into position No. 1 interrupting the beam of light between members 78*a* and 78*b*. This action energizes reversible stepping motor 44 causing the motor to drive the flag 10 outwardly to open up the space between the flag 10 and member 68 (FIG. 5) carrying member 102.

Once clearance has been reestablished pressure on member 102 is relieved enabling spring 92 to pull arm 82 (which carries switch interruptor 90) rightwardly causing the interruptor on the arm to move into the center or neutral position No. 2 deenergizing stepping motor 44. This action (energizing and deenergizing motor 44) continues as items continue to enter the stacker pocket with the flag being moved by the switch and stepping motor to accommodate more and more documents or items. The flag and switch apparatus are so adjusted that the aforesdescribed minimal space (0.0030) is maintained between the member 102 and flag 10 so as to accommodate the incoming item without collison therebetween.

As the stacker pocket fills up with items the flag assembly 10 is moved leftwardly (FIG. 6) by the stepping motor 44 under control of the switch apparatus until the flag mechanism reaches the end of the rack 22. At this point switch interruptor 90 is in the No. 1 position (FIG. 6) and in the normal course the stepping motor is energized so as to drive the flag 10 further leftwardly. However, since the flag is now at the end of its travel on the rack 22 the sorter logic determines that the pocket is full. This is indicated to the operator visually, who can then remove the stacked items from the pocket. The stepping motor is momentarily deenergized until the full pocket condition is relieved.

Once the operator has removed the stack of items from the full pocket spring 92 causes the lower portion of switch arm 82 to swing rightwardly moving the interruptor 90 into position No. 3 interrupting the beam of light between members 80*a* and 80*b* whereupon the stepping motor 44 is energized (reversed) to drive the flag 10 rightwardly until it once more contacts members 102 and 98 pushing switch arm 82 leftwardly against the spring pressure moving interruptor 90 away from member 80*a* and 80*b* and into position No. 2, the neutral or starting position. This action immediately deenergizes stepping motor 44 which places the stacker/pocket in condition for a new sort i.e. the receipt of a new batch of items. The flag 10 acts against the member 98 to hold the switch arm 82 in the neutral position against the tension of spring 92 until items are introduced into the stacker pocket whereupon the stepping motor is once more energized to open a space between member 102 and 98 and flag 10 as before described.

What is claimed is:

1. Item sorter pocket flag and switch apparatus for the pocket receptacle of a sorter reader comprising;

a rack, means engaging said rack for moving the latter in opposite directions along a horizontal, linear path, an item pocket flag carried by and moveable with said rack and adapted to act as a vertical support for items incapable of being self supporting, a flexible member disposed adjacent to said flag and providing complimentary vertical support for said items, switch means including an arm rotatable about an axis spaced intermediate ends of the arm, a first end of the arm supporting said flexible member, said switch means including oppositely disposed photo optical means having a fixed position relative to said axis, interruptor means secured to the second end of said arm to operably energize and deenergize said photo optical means and produce signals as the interposition of items between said pocket flag and said flexible member causes said flexible member to move relative to said flag, and reversible drive means operably coupled to said rack engaging means and controlled by the signals to provide a relatively constant minimal spacing between said flag and said flexible member throughout the length of said rack by adjustably moving said rack to accommodate additional items.

2. The invention in accordance with claim 1 wherein said item pocket flag is an integral, flat, rectangular, horizontally elongated member provided with an L-shaped integral offset support for demountably attaching said flag to said rack enabling said flag to be utilized in a left-right or right-left reverse relationship relative to said back-up member and said item pocket.

3. The invention in accordance with claim 1 wherein said rack includes a mounting structure along which said rack is slideably movable by means of a linear zero clearance bearing, said rack including radially molded teeth permitting said rack to fully engage the teeth of an operably associated drive pinion regardless of any slight angular movement between said rack and said pinion.

4. The invention in accordance with claim 1 wherein said rack includes lower track guide means and an upper pressure point member, the two members in concert maintaining said rack and flag in a true vertical condition throughout the linear movement of said flag and said rack.

5. The invention in accordance with claim 1 wherein said flag, rack and bearing comprise a demountable, modular subassembly for insertion within the sorter pocket receptacle of an item sorter/reader.

6. The invention in accordance with claim 1 wherein said switch means further comprises two sets of photo optical switch members arranged in parallel; spaced apart pairs, and wherein optical interruptor means operably containing said flag includes means for opening and closing said switch means and for energizing and deenergizing said drive motor.

7. The invention in accordance with claim 1 wherein said reversible drive means comprises a reversible motor, said switch means comprises a modular demountable subassembly including optical switch elements at one end and pivot mounting means at the opposite end, and an irregularly shaped elongated rockable member mounted to said pivot mounting means including an item contacting member at one end thereof, an optical switch interruptor integral with the opposite end is moveable into and out of switch actuating position as said pocket is filled and emptied of items, and means connecting said switch means to said reversible motor effective to cause said flag to move toward and away from said back-up member.

* * * * *